US005413226A

United States Patent [19]

Matthews et al.

[11] Patent Number: 5,413,226

[45] Date of Patent: May 9, 1995

[54] APPARATUS FOR SORTING OBJECTS ACCORDING TO SIZE

[75] Inventors: Mark Matthews, Richardson; Michael R. Weidman, Plano, both of Tex.

[73] Assignee: Texas Instruments Incorporated, Dallas, Tex.

[21] Appl. No.: 159,637

[22] Filed: Nov. 30, 1993

[51] Int. Cl.[6] ..... B07B 13/05

[52] U.S. Cl. ..... 209/668; 209/670

[58] Field of Search ..... 209/670, 673, 667, 552, 209/668; 221/21

[56] References Cited

U.S. PATENT DOCUMENTS 2,661,090 12/1953 Garrett ..... 209/668
2,802,560 8/1957 Engleson et al. ..... 221/21
5,066,507 11/1991 Miwa et al. ..... 209/673

*Primary Examiner*—Kenneth W. Noland
*Attorney, Agent, or Firm*—John D. Kaufmann; James C. Kesterson; Richard L. Donaldson

[57] ABSTRACT

A roll (110) sorter includes a pair (111) of counter-rotating rollers (112,114) separated by a gap (124). A sorting region (128) is defined by the gap and the facing roller surfaces (130,132). Particles (46) fed into the sorting region float on the rollers and are sorted into two groups, those that pass through the gap and those that cannot pass through the gap. The accuracy of the sorter is increased by associating a metering facility (220) such as a gate (222) with the sorting region. The metering facility limits the number of particles which can simultaneously enter the sorting region. Typically, the particles enter and move along the sorting region one-at-a-time and in single file.

20 Claims, 3 Drawing Sheets

FIG. 2
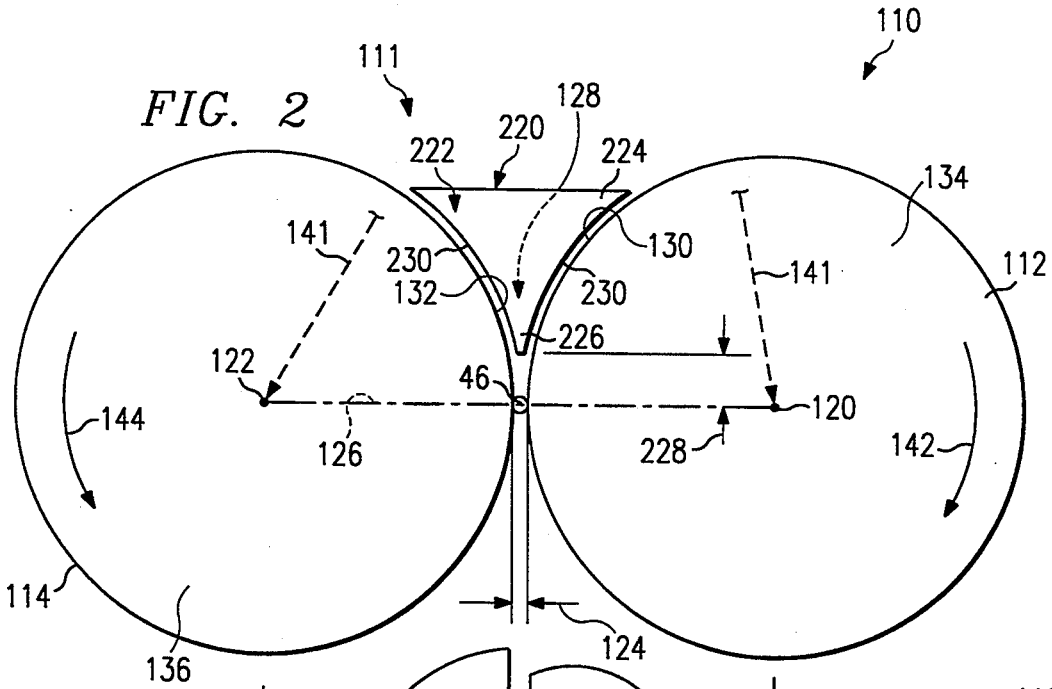
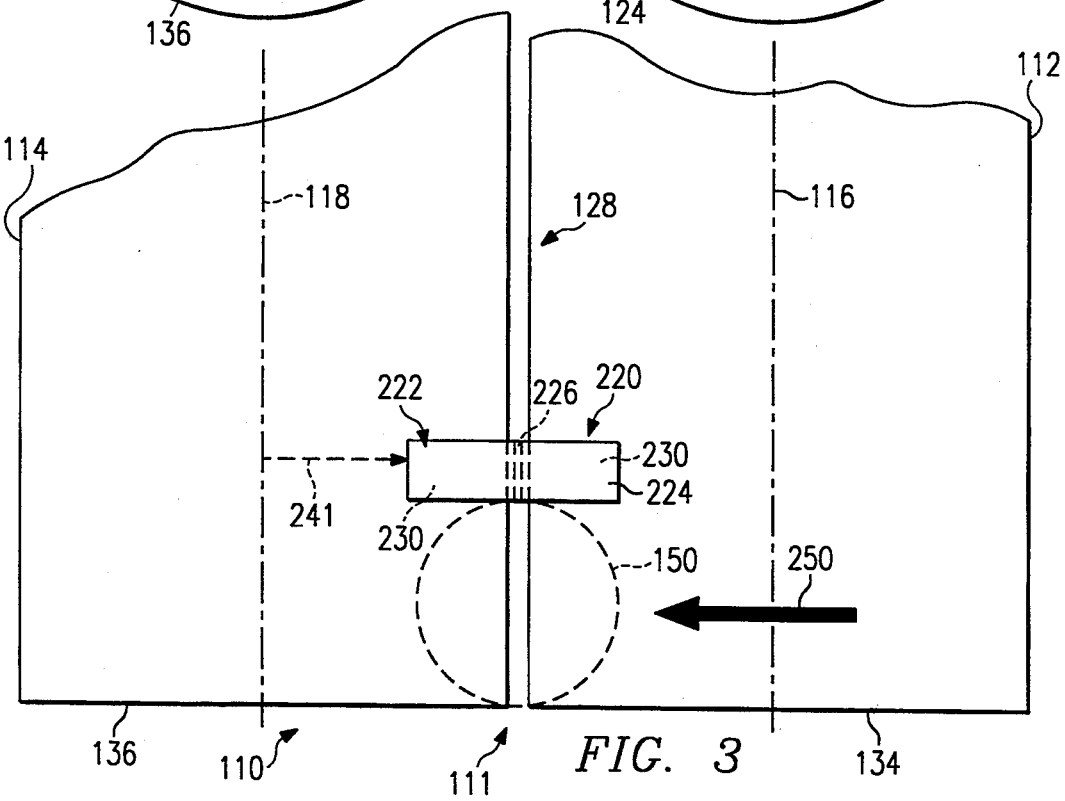
FIG. 3

APPARATUS FOR SORTING OBJECTS ACCORDING TO SIZE

BACKGROUND OF THE INVENTION

The present invention relates to apparatus for sorting objects by size, and, more particularly, to roll sorters for sorting by size easily damageable, generally particulate objects, such as silicon spheres or silicon spheroids which are intended for inclusion in solar cells.

Roll sorters are known. A typical roll sorter comprises a pair of generally horizontally oriented, spaced, generally coextensive, counter-rotatable rollers. The rollers have generally circular cross-sections and are coextensively positioned side-by-side with their axes either substantially parallel or diverging. Where the spaced horizontal rollers are parallel and do not diverge, a more or less uniform gap is defined between the closest approach of their facing surfaces. A widening gap is defined between the facing surfaces of rollers having diverging axes. The uniform or diverging gap between the rollers is generally horizontal, that is, substantially level or slightly tilted from the horizontal the gap may be viewed as being coplanar with an imaginary plane which is defined between and "interconnects" the horizontal major axes of the rollers.

A feeding region, zone or volume is defined above the imaginary plane. The feeding region is bounded by such plane and by the facing surfaces of the horizontal rollers above the plane. The rollers are counter-rotated so that their facing surfaces (a) move through and then upwardly out of the sorting region above the imaginary plane and (b) move toward and then into the sorting region below the imaginary plane.

The rollers are counter-rotated and a quantity of particles having varying sizes is deposited within or fed into the sorting region. The particles may be spheres, such as ball bearings, or spheroids with smooth or uneven surfaces. Because the rollers are counter-rotated in the manner described, they effectively "float" on the roller surfaces and damage thereto is avoided. In effect, floating results in the particles not being drawn into the gap and not being crushed between the rollers, as would be the case if the rollers were oppositely counter-rotated, the particles instead riding on the roller surfaces within the sorting region. The floating particles are maintained in a constant state of agitation by the rotating rollers so that particles in the sorting region which are capable of passing through the gap are periodically presented to and pass through the gap where they fall downwardly into or onto a collector, such as a container or a conveyor.

Over time, the foregoing operation of a roll sorter will sort the particles into two size groups. Particles in the first group are incapable of passing through the gap; these particles may, until removed from the sorting region, remain floating and in a state of agitation on the counter-rotating rollers. Particles in the second group are those which fall through the gap.

Where the gap between the rollers diverges, particles are similarly sorted into two size groups. The first group includes particles unable to fall through even the widest portion of the diverging gap. The second group is comprised of a number of subgroups. Specifically, one subgroup includes particles capable of passing through the narrowest portion of the diverging gap, while a second subgroup includes particles capable of passing through a wider portion of the gap. The number of such subgroups is theoretically infinite, but, in practice is limited to a finite number of subgroups. For example, a first subgroup may include particles capable of passing through a first portion of the diverging gap, such first portion extending a first distance from the narrowest portion of the gap along the rollers to a somewhat wider portion. A collector placed under the rollers and extending therealong for the first distance will collect particles having sizes within a range set by and equal to or smaller than the diverging width of the associated portion of the gap. Subsequent subgroups will include particles having progressively larger ranges of sizes.

If the particles are placed into the sorting region at or near one end or the other of the roller pair, the floating action effected by the counter-rotating rollers tends to distribute the particles along the sorting region. If parallel, non-diverging rollers are used, the particles may be placed into the sorting region at either end of the roller pair. If diverging rollers are used, the particles should be placed in the sorting region at or near the ends of the rollers whereat the gap is the narrowest to take full advantage of the particle distribution along the sorting region caused by the floating action which aids in segregating the particles into the subgroups.

The prior art also contemplates tilting the rollers out of their horizontal orientation so that one end thereof is higher than the other end. Tilting of the rollers effects the gravity-assisted movement of those floating particles which are too large to pass through the gap away from the higher roller ends and toward the lower roller ends. In this fashion, tilting also aids the particle-distributive effect of the floating action. Ultimately, particles which are too large to pass through the gap—either uniform or diverging—are moved to the lower roller pair ends. These too large particles may be permitted or made to leave the lower portion of the sorting region and the associated roller surfaces and fall into or onto a collector, such as a container or a conveyor.

The above-described type of roller sorter is viewed favorably and deemed suitable for the sorting of spherical or nearly spherical silicon particles, particularly those ultimately used in fabricating solar cells. A solar cell, or photovoltaic device, converts incident radiant energy, such as sun light, into electricity.

The following commonly assigned US Patents generally describe spherical or spheroidal silicon particles of the type which may be conveniently sorted by size by a roll sorter, the need to effect sorting of these silicon particles by size, and the type of solar cells in which such size-sorted silicon particles may be included: U.S. Pat. Nos. 5,223,452; 5,208,001; 5,091,319; 5,069,740; and 4,691,076.

Silicon spheres and spheroids used in constructing solar cells—and various other spheres or spheroids which are put to different uses—are small and somewhat fragile and may be damaged due to rough handling. Moreover, solar cells of the kind shown in the above-identified patents preferably include arrays of large numbers of same-sized or close-in-size silicon spheres mounted to flexible metal foils. Typical silicon sphere production techniques produce batches of intermingled silicon spheres or spheroids having varying sizes or diameters, typically 25–45 mils. Thus, manufacturing the above type of solar cell requires accurate, non-damaging sorting of large numbers of small, fragile silicon spheres. Such sorting should be efficient and have high throughput so as not to constitute a bottleneck in a solar cell manufacturing operation.

The present inventors have noted that the accuracy of sorting achieved by using a tilted roll sorter of the above type—with the gap therebetween being either uniform or diverging—may be deleteriously affected by the number of particles "piled" atop each other within the sorting region.

An object of the present invention is the provision of an efficient, non-damaging apparatus for sorting by size small, fragile particles, such as silicon spheres or spheroids, which apparatus achieves high accuracy of sorting.

SUMMARY OF THE INVENTION

With the above and other objects in view, the present invention contemplates improved apparatus for sorting particulate material by size. The particles may be commingled silicon spheres or spheroids having varying sizes which are intended for use in the manufacture of solar cells.

The apparatus is generally of the type described above and includes a pair of adjacent, circular cross-section rollers, the facing surfaces of which are separated by a gap which is coplanar with a plane defined by the rollers' major axes. The rollers may be tilted. A sorting region is defined and bounded by the plane and by the rollers' facing surfaces above the plane. The rollers are counter-rotated so that their facing surfaces above the plane rotate away from the sorting region and below the plane rotate into the sorting region. The particles enter the sorting the sorting region via a feeding zone. Particles within the sorting region float on the counter-rotating rollers.

The improved apparatus includes a facility for metering the particles fed into the input zone. This metering limits the number of particles simultaneously entering the sorting region. Preferably the metering facility effects one-at-a-time entry of the particles into the sorting region. The rollers may be tilted so that particles floating in the sorting region move toward the lower ends of the rollers. As a result, the particles move single file within the sorting region toward the lower roller ends.

The metering facilities may take the form of a gate. The gate has a configuration which is generally complementary to the sorting region and is spaced from the sorting region-defining portions of the plane and the facing roller surfaces.

The improved sorter may also include facilities which detect a build-up of particles at the gate which inhibits or prevents particles from entering the sorting region. The feeding of the particles into the feeding zone may be prevented in response to the detection of such a build-up.

While the one-at-a-time entry of the particles into the sorting region may decrease the throughput of the sorter, very accurate sorting results from the single file movement of the particles in the sorting region.

BRIEF DESCRIPTION OF THE DRAWING

All of the Figures hereof are somewhat diagrammatic or schematic, stylized representations of generalized embodiments of both the prior art and the present invention, wherein:

FIG. 1(*d*) is a plan view of another type of prior art roll sorter;

FIG. 2 is a side view, similar in perspective to FIG. 1(*a*) as though taken from a perspective represented by line 2—2 in FIG. 1(*b*), which depicts a portion of an improved roll sorter similar to those generally shown in FIG. 1 and in which there is provided a facility for metering the entry of particles to increase sorting accuracy; and FIG. 3 is a plan view of the improved roll sorter of FIG. 2 similar in perspective to FIGS. 1(*c*) and 1(*d*).

DETAILED DESCRIPTION

Figure 1A:
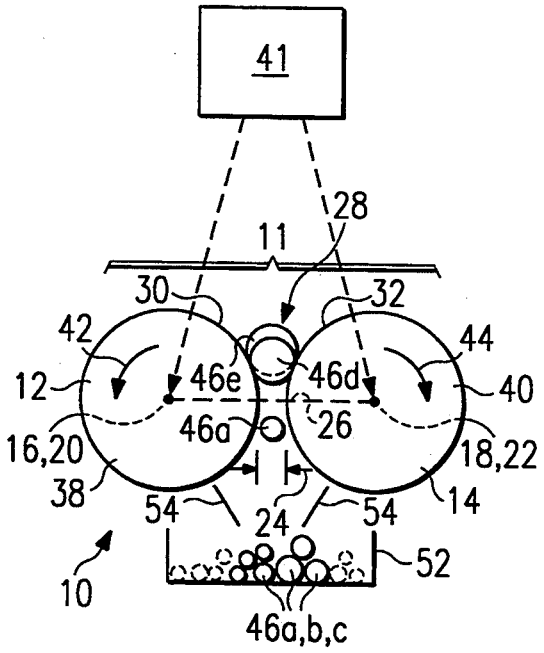
FIG. 1a (PRIOR ART)
FIG. 1 depicts a prior art roll sorter of the type improved by the present invention, in which FIG. 1(*a*) is a side view, FIG. 1(*b*) is a front view taken from the left of FIG. 1(*a*), and FIG. 1(*c*) is a plan view, all being of one type of prior art roll sorter.
Figure 1B:
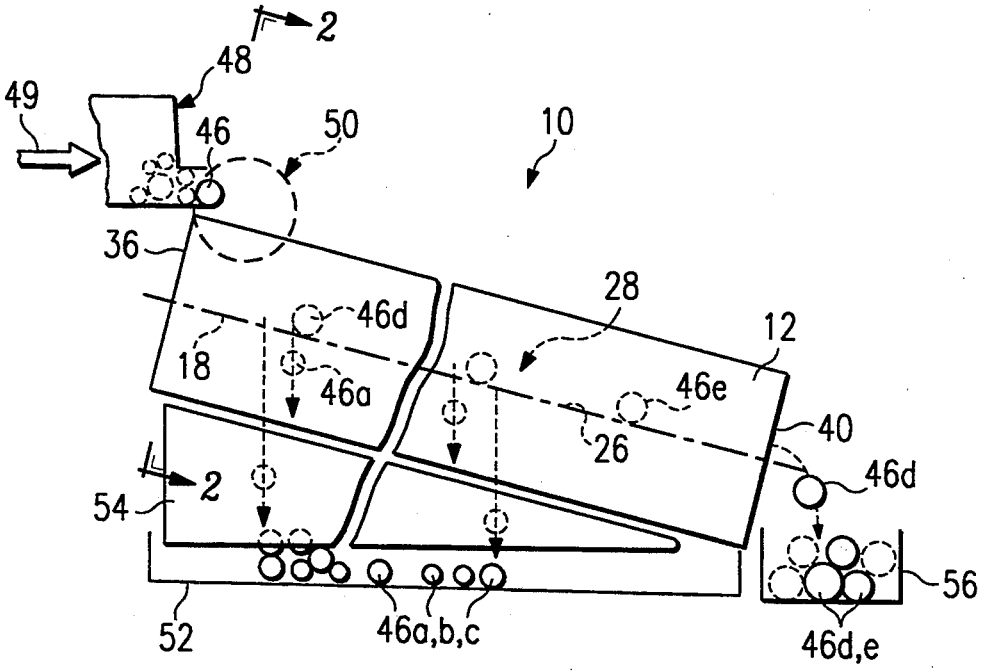
FIG. 1b (PRIOR ART)
Figure 1C:
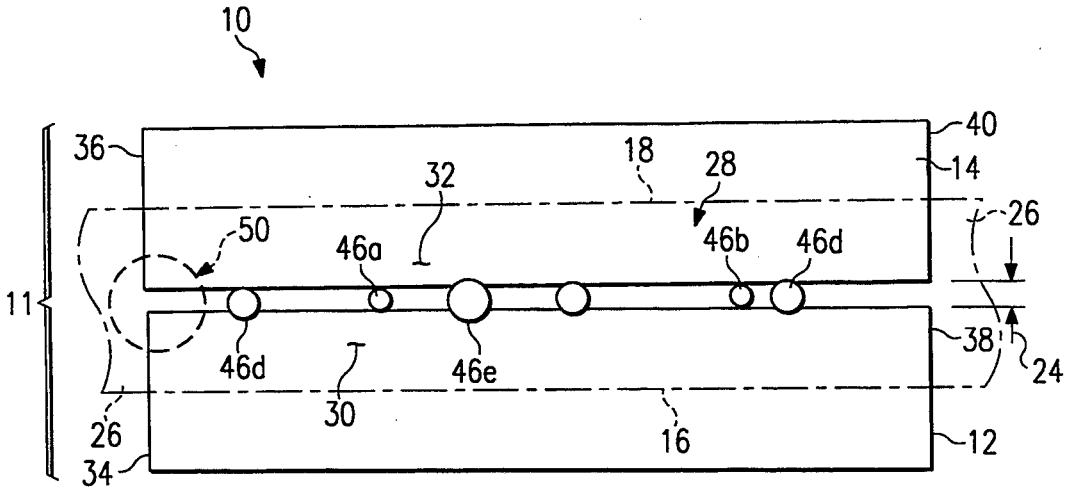
FIG. 1c (PRIOR ART)
Figure 1D:
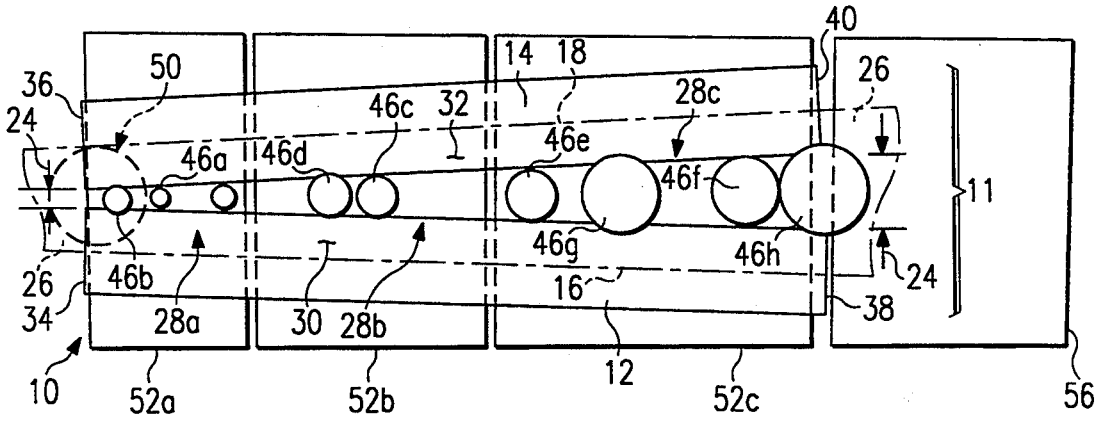
FIG. 1d (PRIOR ART)

Referring first to FIG. 1, there is shown a general depiction of a roll sorter 10 according to the prior art. The elements of the improved roll sorter depicted in FIGS. 2 and 3 are numbered similarly to the elements of the prior art sorter 10. The relative sizes of the elements of all Figures are not to scale in order to better illustrate the principles of the present invention.

As seen in FIGS. 1(*a*)–1(*c*), a typical prior art roll sorter includes a pair 11 of rollers 12 and 14. The rollers 12,14 are preferably right circular cylinders having major axes 16 and 18 and generally circular cross-sections, with centers 20 and 22 through which the axes 16,18 pass. In the prior art sorter 10 of FIGS. 1(*a*)–1(*c*) the rollers 12,14 are positioned side-by-side and may be generally coextensive. In one prior art embodiment, the rollers 12,14 are parallel. As a consequence, the rollers 12,14 are spaced to define a uniform gap 24 therebetween. The uniform gap 24 is coplanar with a plane 26 which is defined and bounded by—and may be viewed as "interconnecting" or containing—the major axes 16,18. A sorting region 28 is defined and bounded by the plane 26 and by the facing surfaces 30 and 32 of the rollers 12,14, with the sorting region 28 lying above the plane 26.

As implied by FIG. 1(*a*), both rollers 12,14 of the roller pair 11 may be substantially level. In this event, the major axes 16,18 of the rollers 12,14, the uniform gap 24, the plane 26 and the sorting region 28 are also level. Preferably, for reasons explained below, the rollers 12,14 may be tilted out of a level orientation so that adjacent ends 34 and 36 of the rollers 12,14 are higher than their respective opposite ends 38 and 40, as shown in FIG. 1(*b*). In this latter event, the major axes 16,18, the uniform gap 24, the plane 26 and the sorting region 28 are also tilted. Both substantially level and tilted rollers 12,14 are referred to herein as "generally horizontal."

As shown in FIG. 1(*d*), the rollers 12,14 may diverge so that the adjacent ends 34,36 are more proximate or closer together than are the opposite ends 38,40. In this event, the gap 24 between the rollers 12,14 is not uniform and widens or diverges as it extends from the proximate ends 34,36 to the ends 38,40. This divergence is highly exaggerated in FIG. 1(*d*). In the case of the diverging rollers 12,14, the major axes 16,18 and the sorting region 28 also diverge, and the major axes 16,18, the diverging gap 24, the plane 26 and the sorting region 28 are substantially horizontal, that is, they may be either level or tilted.

Appropriate mounting facilities of any suitable type may be used to mount the rollers 12,14 and to selectively adjust the width of the gap 24, as described above. The rollers 12,14 are counter-rotated by appropriate, selectively energizable facilities which include a source of motive power and interconnections therefrom to the rollers 12,14. The roller-mounting, gap-adjusting and counter-rotating facilities for the rollers 12,14 are schematically depicted at 41 in FIG. 1(*a*).

Counter-rotation of the rollers 12,14 is indicated by the arrows 42 and 44 in FIG. 1(*a*) and comprises (a) movement of the surfaces 30,32 of the rollers 12,14 out of and away from the sorting region 28 above the plane 26 and (b) movement of the surfaces 30,32 toward and into the sorting region 28 below the plane 26. As illustrated in FIG. 1(*a*) and in similar Figures, appropriate counter-rotation comprises counterclockwise rotation of the left-hand roller 12 and clockwise rotation of the right-hand roller 14.

As shown in FIG. 1(*b*), particulate material 46 is fed by or from a supply 48 into the sorting region 28 of the roller pair 11. Movement of the particles 46 from the supply 48 may be effected by any convenient feed assistant, a conveyor, moving gas, or another similar expedient, all as schematically indicated at 49 in FIG. 1(*b*). As explained below, if the rollers 12,14 are tilted as in FIG. 1(*b*), the particulate material 46 preferably enters the sorting region 28 at an input zone 50 thereof which is located at or near the higher ends 34,36. If the rollers 12,14 diverge, as in FIG. 1(*d*), the input zone 50 is located at or near the proximate ends 34,36. If the rollers 12,14 are both tilted and diverge, the input zone 50 is located at or near the higher, proximate ends 34,36. If the rollers 12,14 do not diverge, the input zone 50 may be located elsewhere in the sorting region 28 relative to the proximate ends 36,38 or may extend or be distributed along some or all of the sorting region 28. In this latter event, the supply 48 and the feed assistant 49 will be configured as necessary.

The sizes of the particles 46 relative to each other and to the sizes of the rollers 12, 14 and the gaps 24 as depicted in FIG. 1 are not to scale and have been depicted only in order to illustrate the present invention.

The particulate material 46 may include commingled particles 46*a*, 46*b* . . . 46*e* . . . etc. of varying sizes or diameters where the particles 46 are generally spherical or spheroidal, 46*a* being the smallest. Referring to FIG. 1(*a*), it assumed that the sorter 10 segregates smaller particles 46*a*, 46*b* and 46*c* from larger particles 46*d*, 46*e* . . . etc. The gap 24 therefore has a width which permits the particles 46*a*, 46*b* and 46*c* to pass therethrough, but which prevents the particles 46*d*, 46*e*. etc., from so passing. Assuming the rollers 12 and 14 are horizontal, the particles 46 are fed from the supply 48 by the feed assistant 49 into the input zone 50 which may be near the roller ends 34, 36 or may be distributed along the rollers 12 and 14 generally coincident with the sorting region 28. As the rollers 12 and 14 counter-rotate, the particles float on the roller surfaces 30, 32 within the sorting region 28. Due to the floating action, the particles 46*a*, 46*b* and 46*c* ultimately reach and pass through the gap 24 where they fall into a collector 52, which may be a bin, conveyor, or the like. The collector 52 extends normally to the plane of FIG. 1(*a*) and may be generally coextensive with the rollers 12 and 14. To ensure that the collector 52 captures the particles 46*a*, 46*b* and 46*c* it may be positioned closely to the rollers 12 and 14 beneath the gap 24 and the sorting region 28, or guides 54 such as a chute, funnel-like plenum, or angled plates may direct the particles 46*a*, 46*b* and 46*c* into the collector 52.

As the smaller particles 46*a*, 46*b* and 46*c* pass through the gap 24, the larger particles 46*d*, 46*e*, etc. continue to float on the roller surfaces 30, 32 within the sorting region 28. These larger particles 46*d*, etc. may be periodically removed, as necessary to permit the sorter 10 to continue operating efficiently. In the foregoing manner, the particles 46 are sorted into two groups, those having sizes equal to or less than the size of the particles 46*c*—assuming that the diameter of the particles 46*c* is roughly equal to the width of the gap 24—and those having sizes equal to or larger than the size of the particles 46*d*.

In FIG. 1(*b*), the need to periodically remove the particles 46*d*, etc. is eliminated by tilting the rollers 12 and 14. The smaller particles 50*a*, etc. pass through the gap 24 into the collector 52, while the larger particles 46*d* move from left to right under the influence of gravity as aided by the floating action until they fall into a receptacle 56 located adjacent the lower ends 38 and 40. In FIG. 1(*b*) the input zone 50 is located near the higher roller ends 34 and 36 to ensure that the smaller particles 46*a*, etc. are not blocked by the larger particles 46*d*, etc. and will, over time, be presented to the sorting region 28 and the gap 24 as the commingled particles 50 float on the roller surfaces 30 and 32.

In FIG. 1(*d*), the rollers 12 and 14 diverge. Starting with the closer roller ends 38 and 40, the diverging gap 24 may be viewed as defining a selected number of sorting regions 28*a*, etc. A range of particles, say 46*a* and 46*b* can pass through the gap 24 somewhere along the region 28*a*, larger particles 46*c* and 46*d* which cannot pass through the gap 24 in the region 28*a*, are able to so pass in the region 28*b*, etc. Largest particles 46*h* are incapable of passing through the gap 24 anywhere along the length of the sorting region 28. If the rollers in FIG. 1(*d*) are also tilted (as in FIG. 1(*b*)), these largest particles 46*h* ultimately exit the sorting region 28 at the lower roller ends 38 and 40 and fall into the receptacle 56. The smaller particles 50*a*–50*g* fall into collectors 52*a*, 52*b*, etc. which are coextensive with the regions 28*a*, 28*b*, etc. The extent of the regions 28*a*, 28*b*, etc., and of the collectors 52*a* are selected as desired to segregate the particles 46 into groups encompassing selected sizes. The input zone 50 is preferably restricted to the closer roller ends 34 and 36 whether or not the sorter 10 of FIG. 1(*d*) is tilted.

In using the sorter 10 of FIG. 1, it has been found by the present inventors that when an excessive number of the particles 46 are present in the input zone 50, the accuracy of sorting decreases. Specifically, and recalling that the commingled particles 46 of varying sizes are typically presented to the input zone 50, an excessive number of particles 46 will include larger particles, such as those 46*e*–46*h* shown in FIG. 1(*d*), and smaller particles 46*a*, 46*b*. If the smaller particles rest on top of the larger particles in the input zone 50, there is a possibility that the smaller particles will continue to so rest during some or all of their movement along the sorting region 28. This may result in the smaller particles 46*a*,46*b* never passing through the gap 24 (in FIGS. 1(*c*) and 1(*d*)) or in passing through a portion of the gap 24 which is much wider than necessary to permit such passage (in FIG. 1(*d*)). In either event, the accuracy of the sorter 10 is compromised whenever the particles 46 do not pass through the gap 24 when they are first able to so pass. The foregoing is true even where the variation in size of the particles 46 in the input zone 50 is small; larger particles 46 underlying smaller particles 46 in the sorting region 28 can prevent the latter from passing through a just wide enough portion of the gap 24, with the smaller particles 46 passing through the gap 24 at a portion thereof which is much wider than necessary.

Accordingly, and referring to FIG. 2, an improved sorter 110 according to the present invention is utilized. While not actually taken along line 2—2 in FIG. 1(*b*) which does not illustrate the present invention, FIG. 2 is taken from the same perspective as indicated by such line 2—2, that is, from the left side of a sorter similar to, but improved over, that shown in FIG. 1(*b*).

The sorter 110 includes a pair 111 of rollers 112, 114, spaced apart by a gap 124 lying at the bottom of a sorting region 128, all along the lines as described with reference to FIG. 1. Preferably, the apparatus 111 will in many applications take the form of FIG. 1(*c*) or 1(*d*) in which the rollers 112,114 are tilted and in which the roller pair 111, the gap 124 and the sorting region 128 diverge.

The sorter 110 also includes a facility 220 for increasing the accuracy of the sorter 110 by metering the particles 46 into the input zone 150 and the sorting region 128. The metering facility 220 preferably effects one-at-a-time entry of the particles 46 into the input zone 150 and the sorting region 128, so that the particles 46 move along the sorting region 128 in single file. In this way, smaller particles 46 cannot be prevented from passing through the gap 124 at the earliest possible moment, thereby ensuring the accuracy of the sorting effected by the sorter 110. The metering facility is associated with the supply 148, the feed assistant 149 and the input zone 150 so as to achieve the aforenoted desiderata.

The metering facility may take the form of a gate 222, as depicted in FIGS. 2 and 3. The gate 222 may include a planar member 224 extending into the sorting region 128 at the input zone 150 thereof. The planar member 224 is tapered or otherwise formed so as to be generally complementary, or similarly shaped with respect, to the sorting region 128 as viewed in FIG. 2. It will be recalled that the sorting region 128 is defined by, and lies above, the plane 126 coincident with the gap 124 and passing through the axes 116,118 of the rollers 112,114 and the facing surfaces 130,132 of the rollers 112,114.

As shown in FIG. 2, the member 224 includes a first nose-like portion 226 which is located between the rollers 112,114 and which terminates just above the plane 126 and the gap 124 and is separated therefrom by a distance 228. The portion 226 may terminate bluntly as depicted or in a point. The portion 226 is contiguous with second curved portions 230 on either side thereof which are spaced from, but are similarly shaped with respect to, the facing surfaces 128,130 of the rollers 112,114. The member 224 may be located at or near the ends 134,136 of the rollers 112,114, as shown, and may be maintained in this location by facilities, schematically shown at 241, which cooperate with the facilities 41 in FIG. 1(*a*). The member 224 may be positionally related to the supply 148 so that the input zone 150 is located as shown in FIG. 2.

The distance 228 between the terminus of the portion 226 and the plane 126 (and the gap 124) is selected so as to meter or limit the number of particles 46 that can simultaneously enter the sorting region 128 from the input zone 150. Those skilled in the art will appreciate that, given rollers 112,114 of predetermined diameters, a gap 124 of a predetermined width and particles 46 having sizes within a predetermined range, the distance 228 can be selected so that only a few particles 46 can simultaneously enter the sorting region 128. As the number of particles 46 which are permitted to simultaneously enter the sorting region 128 decreases, there is a decrease in the possibility that a smaller particle 46 will be prevented from passing through the gap 124 when it is first able to do so.

The spacing of the second portions 230 from the roller surfaces 130,132 is sufficiently small to prevent any particles 46 from passing therethrough. This prevents the particles 46 from by-passing the spacing between the first portion 226 and the gap 124.

Ideally, the particles 46 enter the sorting region 128 one-at-a-time. Such one-at-a-time entry is theoretically possible only if the diameters of the largest particles 46 are not too much larger than the diameters of the smallest particles 46. If this condition is met, the distance 228 may be selected to substantially ensure one-at-a-time entry of the particles 46. If there is too large a size disparity in the diameters of the commingled particles 46, the particles 46 may either be pre-sorted in other apparatus, or accuracy may be only slightly compromised by selecting a distance 228 which may periodically permit more than one particle 46 to enter the sorting region 128.

Because an excessive number of the particles 46 are present in the input zone 150, clogging may occur which prevents any particles 46 from entering the sorting region 128 from between the first portion 226 and the plane 126. In view thereof, facilities, generally designated by the reference numeral 250 may be included which sense such clogging. These facilities 250, which may be optical, mechanical or electromechanical, may sense the height, level, or other property of the mass of particles 46 within the input zone 150 to determine if the particles 46 are properly moving into the sorting region 128 or are clogged in the input zone 150. If the facilities 250 sense such clogging, they may respond by effecting deactivation of the supply 148 or its feed assistant 149 until clogging ceases.

What is claimed is:

1. Improved apparatus for sorting particulate material by size, the apparatus being of the type which includes (i) a pair of adjacent rollers having generally circular cross-sections, the facing surfaces of the rollers being separated by a gap which is coplanar with a plane defined by the major axes of the rollers, a sorting region being generally defined and bounded by the plane and the facing surfaces of the rollers above the plane; (ii) facilities for counter-rotating the roller surfaces away from the sorting region above the plane and toward the sorting region below the plane; and (iii) facilities for feeding the material into the sorting region at an input zone; wherein the improvement comprises:

stationary and non-rotatable means for metering the material fed into the input zone to limit the number of particles entering the sorting region during a selected time.

2. Improved apparatus as in claim 1, wherein:

the metering means effects one-at-a-time entry of the particles into the sorting region.

3. Improved apparatus as in claim 1, wherein:

the metering means comprises a gate which has a configuration generally complementary to the sorting region and which is spaced from those portions of the plane and the facing surfaces of the rollers which define the sorting region.

4. Improved apparatus as in claim 3, wherein:

the spacing between gate and the plane is such that only one particle at-a-time can enter the sorting region.

5. Improved apparatus as in claim 1, wherein:

the metering means comprises a gate having a first portion which is spaced from the plane and second portions which are continuous with the first portion and are generally complementary with and spaced from the roller surfaces.

6. Improved apparatus as in claim 5, wherein:

the spacing between the gate portions and both the plane and the roller surfaces permits no more than a predetermined number of particles to simultaneously enter the sorting region.

7. Improved apparatus as in claim 6, wherein:

the predetermined number is one.

8. Improved apparatus as in claim 1, wherein:

the rollers are tilted between higher ends and lower ends so that particles in the sorting region tend to move toward the lower ends of the rollers.

9. Improved apparatus as in claim 8, wherein:

the input zone is located at or near the higher ends of the rollers.

10. Improved apparatus as in claim 9, wherein:

the metering means comprises a gate located near the higher ends of the rollers, the gate having a first portion which is spaced from the plane and second portions which are continuous with the first surface and are generally complementary with and spaced from the roller surfaces within the sorting region.

11. Improved apparatus as in claim 10, wherein:

the spacing between the gate portions and both the plane and the roller surfaces permits no more than a predetermined number of particles to simultaneously enter the sorting region.

12. Improved apparatus as in claim 11, wherein:

the predetermined number is one so that the particles in the sorting region move toward the lower ends of the rollers in single file.

13. Improved apparatus as in claim 1, which further comprises:

means for detecting a build-up of the particles in the input zone which build-up inhibits or prevents particles from entering the sorting region.

14. Improved apparatus as in claim 13, wherein:

the detecting means prevents further particles from being fed into the input zone in response to the detection of the build-up.

15. Improved apparatus for sorting particulate material by size, the apparatus being of the type which includes (i) a pair of adjacent, generally coextensive rollers, the rollers having generally circular cross-sections, the facing surfaces of the rollers being separated by a gap which is coplanar with a generally horizontal plane defined by the major axes of the rollers, a sorting region being generally defined and bounded by the plane and the facing surfaces of the rollers above the plane; (ii) means for counter-rotating the roller surfaces away from the sorting region above the plane and toward the sorting region below the plane, so that particulate material fed into the sorting region floats on the counter-rotating surfaces of the rollers until particulate material which is equal in size to or smaller in size than the gap passes through the gap, particulate material which is larger in size than the gap being retained in the sorting region and floating on the counter-rotating surfaces of the rollers; and (iii) facilities for feeding the material into the sorting region at an input zone; wherein the improvement comprises:

stationary and non-rotatable means for metering the flow of the material into the input zone to limit the number of particles entering the sorting region during a selected time.

16. Improved apparatus as in claim 15, wherein:

the rollers are tilted between higher and lower ends so that particles floating in the sorting region tend to move toward the lower ends of the rollers, the input zone is located at or near the higher ends of the rollers, and the metering means effects one-at-a-time entry of the particles into the sorting region so that the particles in the sorting region move toward the lower ends of the rollers in single file.

17. Improved apparatus for sorting particulate material by size, the apparatus being of the type which includes (i) a pair of adjacent rollers having generally circular cross-sections, the facing surfaces of the rollers being separated by a gap which is coplanar with a plane defined by the major axes of the rollers, a sorting region being generally defined and bounded by the plane and the facing surfaces of the rollers above the plane; (ii) facilities for counter-rotating the roller surfaces away from the sorting region above the plane and toward the sorting region below the plane; and (iii) facilities for feeding the material into the sorting region at an input zone; wherein the improvement comprises:

means for metering the material fed into the input zone so that the particles enter the sorting region one-at-a-time.

18. Improved apparatus as in claim 17, wherein:

the metering means comprises a gate which has a configuration generally complementary to the sorting region and which is spaced from those portions of the plane and the facing surfaces of the rollers which define the sorting region.

19. Improved apparatus as in claim 17, which further comprises:

means for detecting a build-up of the particles in the input zone, which build-up inhibits or prevents particles from entering the sorting region, for preventing further particles from being fed into the input zone.

20. Improved apparatus for sorting particulate material by size, the apparatus being of the type which includes (i) a pair of adjacent, generally coextensive rollers, the rollers having generally circular cross-sections, the facing surfaces of the rollers being separated by a gap which is coplanar with a generally horizontal plane defined by the major axes of the rollers, a sorting region being generally defined and bounded by the plane and the facing surfaces of the rollers above the plane; (ii) means for counter-rotating the roller surfaces away from the sorting region above the plane and toward the sorting region below the plane, so that particulate material fed into the sorting region floats on the counter-rotating surfaces of the rollers until particulate material which is equal in size to or smaller in size than the gap passes through the gap, particulate material which is larger in size than the gap being retained in the sorting region and floating on the counter-rotating surfaces of the rollers; and (iii) facilities for feeding the material into the sorting region at an input zone; wherein the improvement comprises:

means for metering the flow of the material into the input zone so that the particles enter the sorting region one-at-a-time.

* * * * *